US011490654B2

(12) United States Patent
Doner

(10) Patent No.: US 11,490,654 B2
(45) Date of Patent: Nov. 8, 2022

(54) CIGAR CUTTER

(71) Applicant: Henry Doner, Berlin, NJ (US)

(72) Inventor: Henry Doner, Berlin, NJ (US)

( * ) Notice: Subject to any disclaimer, the term of this patent is extended or adjusted under 35 U.S.C. 154(b) by 566 days.

(21) Appl. No.: 16/373,801

(22) Filed: Apr. 3, 2019

(65) Prior Publication Data

US 2020/0315248 A1 Oct. 8, 2020

(51) Int. Cl.
*A24F 13/26* (2006.01)
*A24F 13/20* (2006.01)

(52) U.S. Cl.
CPC ..... *A24F 13/26* (2013.01); *A24F 13/20* (2013.01)

(58) Field of Classification Search
CPC ..... A24F 13/24; A24F 13/26; A24F 19/14; A24F 13/18; A24F 47/00
See application file for complete search history.

(56) References Cited

U.S. PATENT DOCUMENTS

| | | | | |
|---|---|---|---|---|
| 340,212 A | | 4/1886 | Heath et al. | |
| 377,550 A | | 2/1888 | Elterich | |
| 1,119,220 A | | 12/1914 | Bates | |
| 1,336,724 A | | 4/1920 | Berberich | |
| 1,637,172 A | * | 7/1927 | Burress | A24F 19/14 224/276 |
| 1,757,607 A | | 4/1928 | Zullo | |
| 1,827,360 A | * | 10/1931 | Glomb | A24F 19/14 131/237 |
| 1,908,890 A | | 5/1933 | Burns | |
| 2,671,454 A | | 3/1954 | Williams | |
| 3,270,938 A | * | 9/1966 | Rhinegold | B65D 83/0888 229/101 |
| 4,160,318 A | | 7/1979 | Morel | |
| 4,846,820 A | * | 7/1989 | Jensen | A61F 5/445 604/339 |
| 5,345,952 A | * | 9/1994 | Nielander | A24F 13/20 131/235.1 |
| 5,893,212 A | * | 4/1999 | Meister | A24F 13/26 30/113 |
| 2004/0020501 A1 | * | 2/2004 | Chenelle | A24F 13/24 131/248 |

FOREIGN PATENT DOCUMENTS

| | | |
|---|---|---|
| DE | 34647 C | 9/1885 |
| DE | 572673 C | 3/1933 |
| DE | 887711 C | 8/1953 |
| FR | 405554 A | 1/1910 |
| FR | 424205 A | 5/1911 |

* cited by examiner

*Primary Examiner* — Niki Bakhtiari
*Assistant Examiner* — Stephanie Lynn Moore
(74) *Attorney, Agent, or Firm* — Kim IP Law Group LLC

(57) ABSTRACT

A cigar cutter including a substantially planar housing body having a first surface and a second surface opposite the first surface. A blade having a cutting edge is movably mounted within the substantially planar housing body. A through hole extends between the first and second surfaces, wherein the blade is moveable to pass through the through hole substantially perpendicular to a central axis of the through hole. A receptacle having an open end is mounted to the second surface and circumscribes the through hole. The receptacle may be removably mounted to the second surface.

16 Claims, 5 Drawing Sheets

CIGAR CUTTER

The exemplary embodiments of subject disclosure relate generally to a cigar cutter, and more specifically, to a cigar cutter having a receptacle for retaining matter cut from a burning end of a cigar until such time that the cut matter can be safely and cleanly disposed.

BACKGROUND OF THE DISCLOSURE

A conventional cigar cutter is constructed as an elongated body having an opening for receiving a cigar and at least one knife moveable within the body for cutting a portion of a cigar upon insertion of the cigar in the opening. Such cigar cutters remove the tipped end or cap of the cigar to enable the user to draw smoke through the cigar. The matter cut from the cigar merely falls from the cigar cutter once it is cut. Conventional cigar cutters are not designed to cut matter including burnt ash, burning tobacco and/or unburned tobacco from the burning end of a cigar and do not possess structure for storing such matter for proper disposal once it is cut.

Thus, a need still exists for a cigar cutter that is capable of addressing the above deficiencies of conventional cigar cutters.

BRIEF SUMMARY OF THE DISCLOSURE

In accordance with an exemplary embodiment there is provided a cigar cutter comprising a substantially planar housing body including a first surface and a second surface opposite the first surface. The cigar cutter further comprises a blade having a cutting edge. The blade is movably mounted within the substantially planar housing body. A through hole extends between the first and second surfaces, and the blade is moveable to pass the through hole substantially perpendicular to a central axis of the through hole. A receptacle having an open end removably mounted to the second surface circumscribes the through hole.

An aspect of the exemplary embodiment is that the cigar cutter further comprises a fastener releasably connecting the receptacle to the second surface. The second surface may include the fastener. The fastener may comprise threads for engaging cooperating threads on the second surface. In addition, the receptacle may include knurlings on an outer surface thereof and the cigar cutter may further comprise a seal for substantially hermetically sealing the receptacle when the blade covers the through hole.

Another aspect of the exemplary embodiment is that the cigar cutter further comprises a first ring attached to the blade at an end thereof opposite the cutting edge, whereby movement of the first ring in a first direction moves the cutting edge to expose the through hole for allowing passage of a cigar through the through hole and into the receptacle. Movement of the first ring in a second direction moves the cutting edge past the through hole for cutting the cigar inserted through the through hole and to seal the through hole, thereby enclosing ash or unburned cigar material in the receptacle.

In accordance with the subject disclosure there is provided a method for capturing and disposing of ash or unburned cigar material from a cigar comprising, using the cigar cutter constructed according to the exemplary embodiment, inserting a cigar within the through hole, moving the blade to cover the through hole and cut the cigar, and holding the blade in the position covering the through hole for a sufficient amount of time to extinguish cigar ash within the receptacle.

In accordance with an additional exemplary embodiment there is provided a cigar cutter comprising a housing body that includes a front surface, a rear surface opposite the front surface, and a through hole extending through the front and rear surfaces. The cigar cutter further comprises a blade moveable within the housing body between a first position spaced from the through hole and a second position completely covering the through hole, and a collapsible receptacle having an open end mounted to the rear surface and circumscribing the through hole.

An aspect of the additional exemplary embodiment is that the collapsible receptacle is removably mounted to the rear surface and includes a bellows side wall. The collapsible receptacle may comprise a metal or other fire resistant material, and the cigar cutter may further comprise a seal for sealing the collapsible receptacle when the blade is in the second position.

In accordance with the subject disclosure there is provided a method for capturing and disposing of ash or unburned cigar material from a cigar comprising, using the cigar cutter constructed according to the additional exemplary embodiment, inserting a cigar within the through hole, moving the blade to the second position, and holding the blade in the second position for a sufficient amount of time to extinguish the cigar ash. The method may further comprise collapsing the collapsible receptacle to remove the cut cigar portion from the cigar cutter.

In accordance with the exemplary embodiments, there are provided cigar cutters and methods of using same that overcome the disadvantages of conventional cigar cutters referenced above. In particular, the cigar cutters and methods according to the exemplary embodiments are capable of cutting and retaining matter cut from an end of a cigar, particularly burning tobacco and ash, until such time that the cut matter can be safely and cleanly disposed.

Other features and advantages of the subject disclosure will be apparent from the following more detail description of the exemplary embodiments.

BRIEF DESCRIPTION OF THE SEVERAL VIEWS OF THE DRAWINGS

The foregoing summary, as well as the following detailed description of the exemplary embodiments of the subject disclosure, will be better understood when read in conjunction with the appended drawings. For the purpose of illustrating the present disclosure, there are shown in the drawings exemplary embodiments. It should be understood, however, that the subject application is not limited to the precise arrangements and instrumentalities shown.

DETAILED DESCRIPTION OF THE DISCLOSURE

Figure 1:
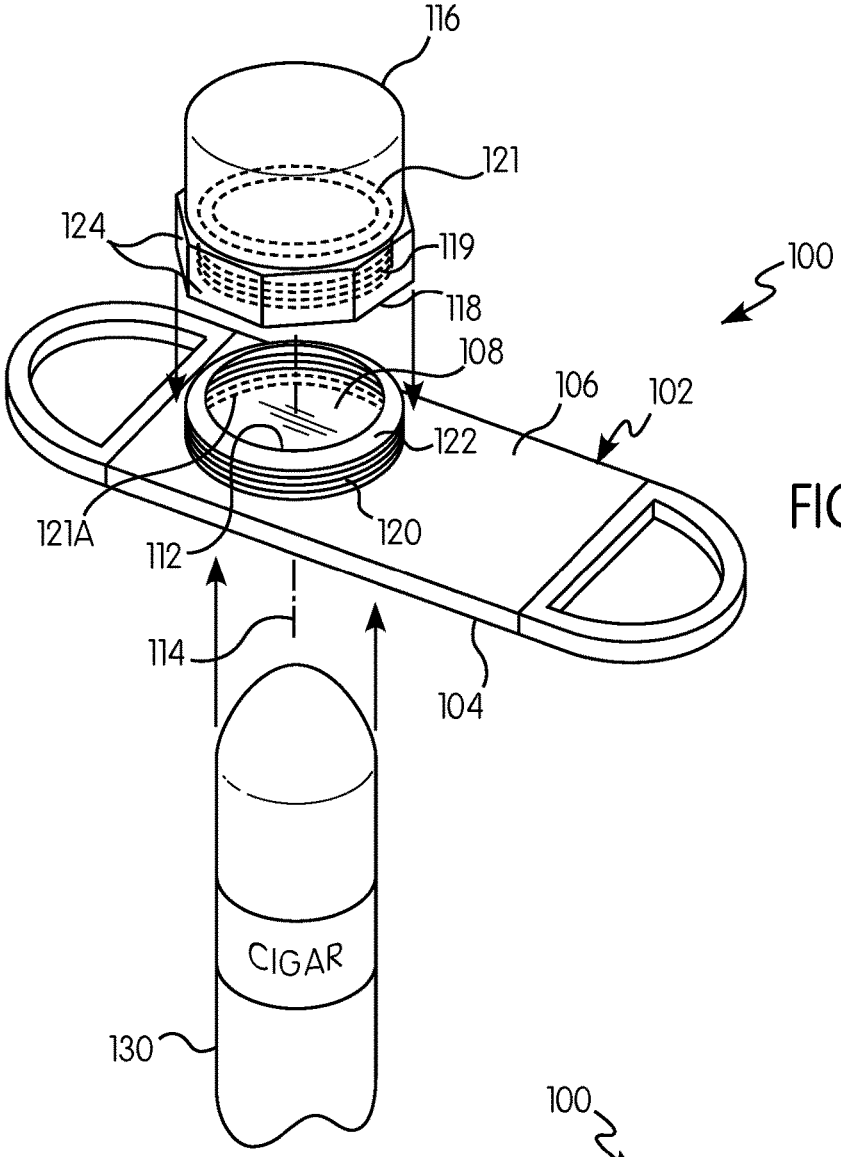
FIG. 1 is an exploded perspective view of a cigar cutter in accordance with an exemplary embodiment of the subject disclosure with a cigar poised for insertion therein.
Figure 2:
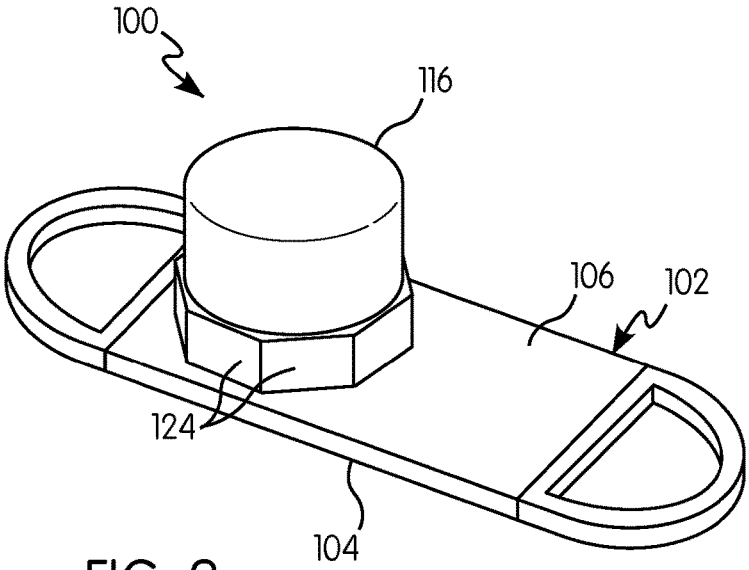
FIG. 2 is a perspective view of the cigar cutter of FIG. 1.
Figure 3:
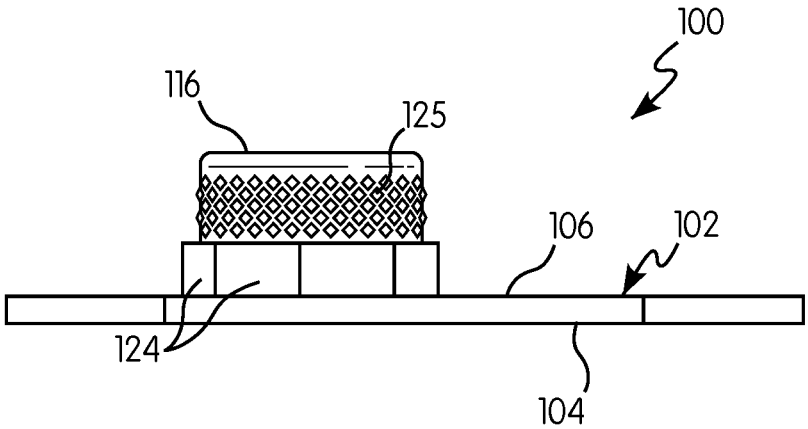
FIG. 3 is a side elevational view of the cigar cutter of FIG. 2.
Figure 4:
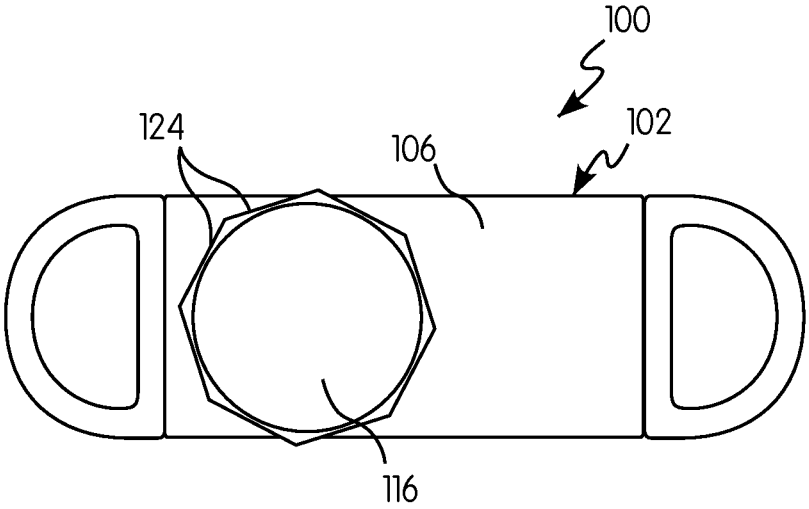
FIG. 4 is a top plan view of the cigar cutter of FIG. 2.
Figure 5:
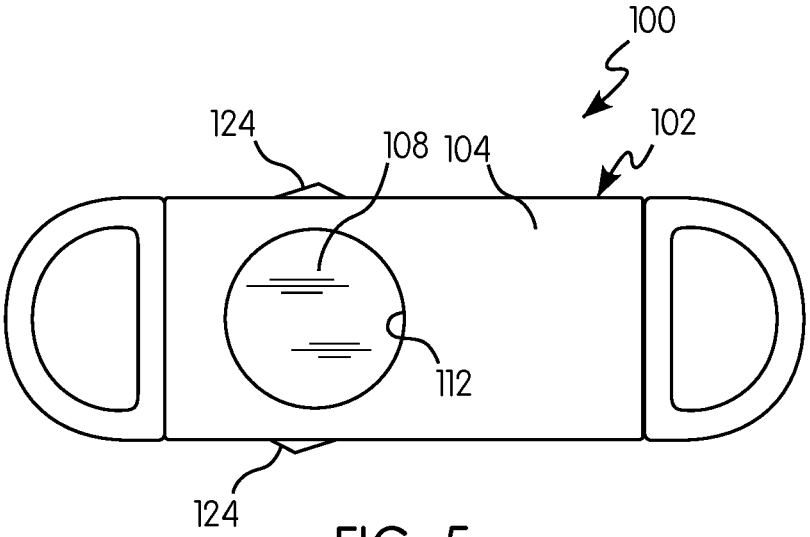
FIG. 5 is a bottom plan view of the cigar cutter of FIG. 2.

Reference will now be made in detail to the various exemplary embodiments of the subject disclosure illustrated in the accompanying drawings. Wherever possible, the same or like reference numbers will be used throughout the drawings to refer to the same or like features. It should be noted that the drawings are in simplified form and are not drawn to precise scale. Certain terminology is used in the following description for convenience only and is not limiting. Directional terms such as top, bottom, left, right, above, below and diagonal, are used with respect to the accompanying drawings. The term "distal" shall mean away from the center of a body. The term "proximal" shall mean closer towards the center of a body and/or away from the "distal" end. The words "inwardly" and "outwardly" refer to directions toward and away from, respectively, the geometric center of the identified element and designated parts thereof. Such directional terms used in conjunction with the following description of the drawings should not be construed to limit the scope of the subject application in any manner not explicitly set forth. Additionally, the term "a," as used in the specification, means "at least one." The terminology includes the words above specifically mentioned, derivatives thereof, and words of similar import.

"About" as used herein when referring to a measurable value such as an amount, a temporal duration, and the like, is meant to encompass variations of ±20%, ±10%, ±5%, ±1%, or ±0.1% from the specified value, as such variations are appropriate.

"Substantially" as used herein shall mean considerable in extent, largely but not wholly that which is specified, or an appropriate variation therefrom as is acceptable within the field of art.

Throughout the subject application, various aspects thereof can be presented in a range format. It should be understood that the description in range format is merely for convenience and brevity and should not be construed as an inflexible limitation on the scope of the subject disclosure. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Furthermore, the described features, advantages and characteristics of the exemplary embodiments of the subject disclosure may be combined in any suitable manner in one or more embodiments. One skilled in the relevant art will recognize, in light of the description herein, that the subject disclosure can be practiced without one or more of the specific features or advantages of a particular exemplary embodiment. In other instances, additional features and advantages may be recognized in certain embodiments that may not be present in all exemplary embodiments of the present disclosure.

Referring now to the drawings, FIGS. 1 through 6 illustrate a cigar cutter 100 in accordance with an exemplary embodiment of the present disclosure. Cigar cutter 100 comprises a substantially planar housing body 102 including a first surface or front surface 104 and a second surface or rear surface 106 opposite the first surface or front surface. A blade 108 having a cutting edge 110 (FIG. 6) is movably mounted within the substantially planar housing body 102. A through hole 112 having a central axis 114 extends between the first or front surface 104 and the second or rear surface 106. The blade 108 is moveable to pass through the through hole 112 substantially perpendicular to the central axis 114 of the through hole. A receptacle 116 having an open end 118 is removably mounted to the second or rear surface 106 and circumscribes the through hole 112.

Figure 6:
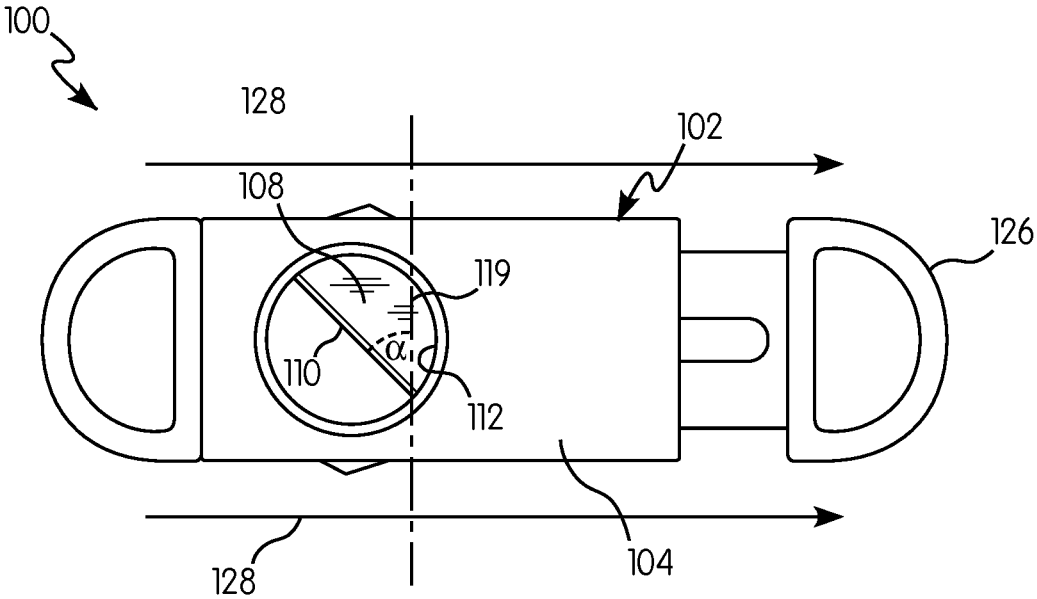
FIG. 6 is a bottom plan view of the cigar cutter of FIG. 1 depicting a cigar cutting blade thereof being moved to accommodate insertion of a cigar within a through hole of the cigar cutter.
Figure 7:
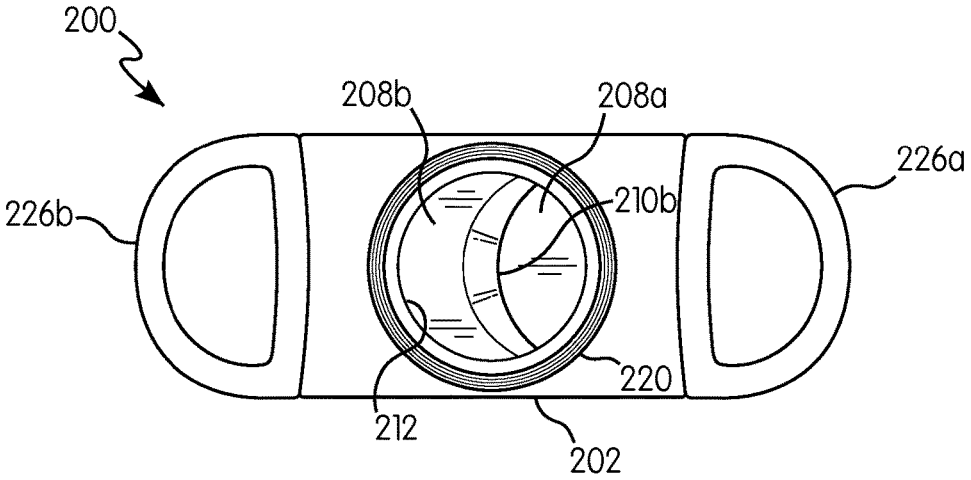
FIG. 7 is a top plan view of a cigar cutter in accordance with another exemplary embodiment of the subject disclosure with the cutting blades thereof in fully closed position and with a receptacle thereof omitted for clarity of illustration.
Figure 8:
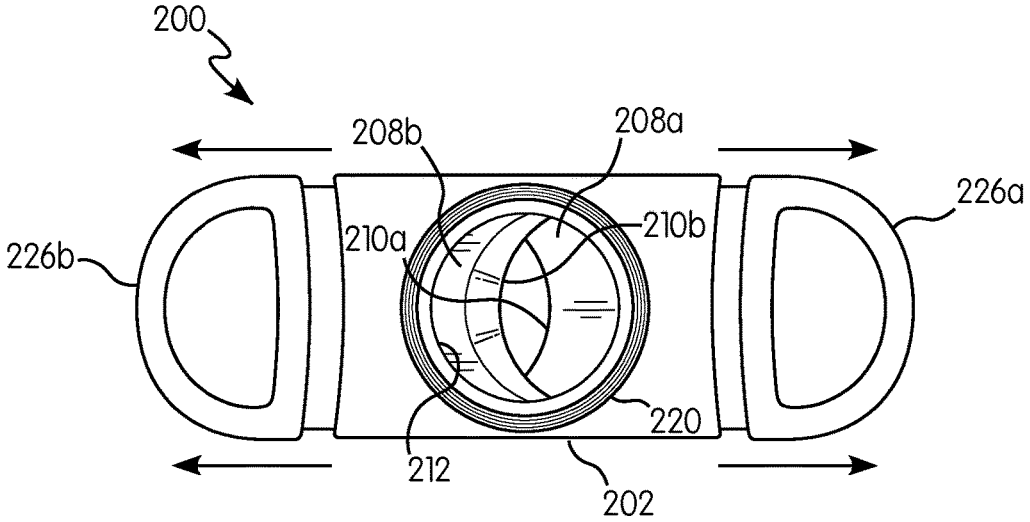
FIG. 8 is a top plan view of the cigar cutter of FIG. 7 with the cutting blades thereof in partially open position.
Figure 9:
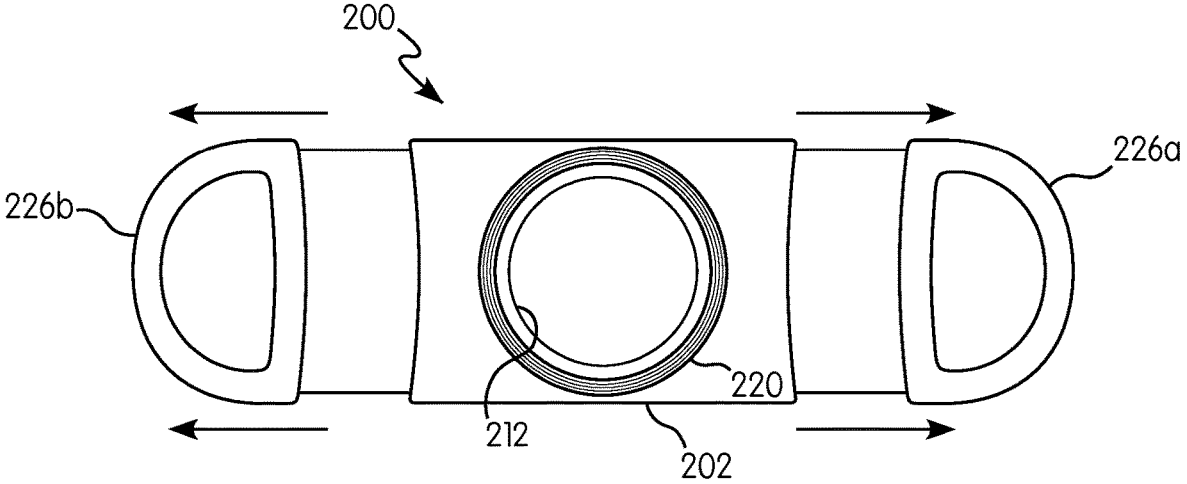
FIG. 9 is a top plan view of the cigar cutter of FIG. 7 with the cutting blades thereof in a fully open position.

The substantially planar housing body 102 is fabricated from substantially rigid to rigid materials such as a metal, a composite, or a plastic, and the blade 108 can be formed e.g. from such rigid materials. According to an aspect, the cutting edge 110 of the blade 108 can be disposed at an angle $\alpha$ ranging from about 0 degrees to about 75 degrees relative to a transverse axis 119 (FIG. 6) of the blade. As shown in FIG. 6, a representative, although not limitative, angle of the cutting edge is about 45 degrees. As indicated by FIGS. 7 through 9, discussed below, the cutting edge of the blade 108 may also assume a curved shape.

According to an aspect, the receptacle 116 may be fabricated from metal or other fire resistant material and includes structure on its outer surface for facilitating gripping and turning of the receptacle. Such structure may include a plurality of flat surfaces 124 or knurlings 125.

According to an aspect, the cigar cutter 100 further comprises a fastener releasably connecting the receptacle 116 to the second or rear surface 106. Such fastener may comprise internal threads 119 provided adjacent the open end 118 of the receptacle for engaging a cooperating fastener, such as threads 120 on the second surface 106, e.g., on the exterior of the through hole 112.

As shown in FIG. 1, the cigar cutter may further comprise a seal 121 for substantially hermetically sealing the receptacle when the blade 108 covers the through hole. According to an aspect, the seal may comprise a gasket, O-ring or the like located internally of the receptacle 116 that comes into sealing contact with an upper edge 122 of the through hole 112 when the receptacle is fastened to the threads 120. Alternatively, or in addition to seal 121, a seal 121A may be positioned adjacent the rear surface 106.

Referring to FIG. 6, the cigar cutter 100 further comprises a first ring 126 attached to the blade 108 at an end thereof opposite the cutting edge 110, whereby movement of the first ring in a first direction (as shown by arrows 128) moves the cutting edge to expose the through hole 112 for allowing passage of a cigar 130 (FIG. 1) through the through hole and into the receptacle. Likewise, movement of the first ring 126 in a second direction moves the cutting edge pass the through hole 112 for cutting the cigar inserted through the through hole and to seal the through hole (FIG. 5), thereby enclosing ash or unburned cigar material in the receptacle.

FIGS. 7 through 9 show a cigar cutter 200 in accordance with another exemplary embodiment of the present disclosure, in particular, with the receptacle removed to show cooperating blades 208*a* and 208*b* contained within a substantially planar housing body 202. As shown in FIGS. 7 and 8, the cutting edges 210*a* and 210*b* of the blades 208*a*, 208*b* are curved rather than angled. In addition, the substantially planar housing body 202 includes first and second rings 226*a* and 226*b* connected to the blades for moving the blades into and out of a cigar-cutting and through hole-covering position. As with through hole 112, through hole 212 can be provided with a fastener such as external threading 220 for cooperating with corresponding threading provided on the receptacle, such as receptacle 116. The first and second rings 226*a*, 226*b* are moved outwardly away from the housing body 202 when it is desired to open the through hole 212 to provide access for a cigar. Conversely, the first and second rings 226*a*, 226*b* are moved inwardly towards the housing body 202 when it is desired to cut a cigar and close the through hole 212.

According to an aspect, the present disclosure provides a method for capturing and disposing of ash or unburned cigar material comprising, using the cigar cutter 100 or 200, inserting a cigar within the through hole 112 or 212, moving the blade 108 or blades 208 to cut the cigar and cover the through hole, and holding the blade 108 or blades 208 in position covering the through hole for a sufficient amount of time to extinguish cigar ash in the receptacle 116. Once enclosed in the receptacle, the unburned cigar material is deprived of oxygen, thereby resulting in complete extinguishment of the unburned cigar material, typically in one minute or less. Upon extinguishment of the unburned cigar material, the receptacle 116 may be removed from the housing body 102 or 202, whereby the ash of the extinguished cigar material may be safely dumped from the receptacle into a trash can or similar container.

Figure 10:
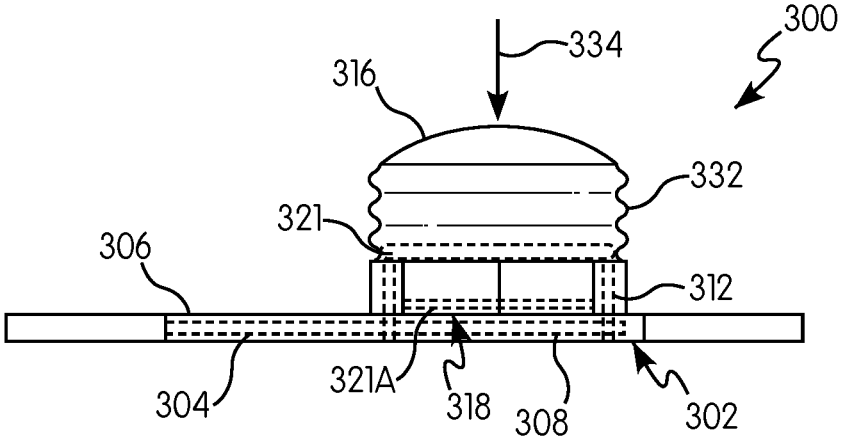
FIG. 10 is a side elevational view of a cigar cutter in accordance with a further exemplary embodiment of the subject disclosure in an assembled condition.

FIG. 10 illustrates a cigar cutter 300 in accordance with a further exemplary embodiment of the subject disclosure. Similar to the cigar cutters 100 and 200 described above, cigar cutter 300 comprises a substantially planar housing body 302 including a first or front surface 304 and a second or rear surface 306 opposite the first or front surface. A through hole 312 extends through the front and rear surfaces. A blade 308 having a cutting edge similar to either blade 110 or 210 is movably mounted within the substantially planar housing body 302 between a first position spaced from the through hole 312 and a second position completely covering the through hole. Cigar cutter 300 further comprises a collapsible receptacle 316 having an open end 318 mounted to the rear surface 306 and circumscribing the through hole.

According to an aspect, the collapsible receptacle 316 is removably mounted to the rear surface 306 such as by cooperating threading provided on the exterior of the through hole and the interior of the collapsible receptacle. In order to facilitate collapsibility, the collapsible receptacle 316 includes a bellows side wall 332 comprised of metal or other fire resistant flexible material. Similar to cigar cutter 100, cigar cutter 300 may further comprise seals 321, 321A for sealing the collapsible receptacle when the blade is in the second position. Such seal may be located at an upper edge of the through hole 312 or adjacent the rear surface 306 when the receptacle is fastened to the through hole.

According to an aspect, the present disclosure provides a method for capturing and disposing of ash or unburned cigar material comprising, using the cigar cutter 300, inserting a cigar within the through hole 312, moving the blade 308 to the second position, and holding the blade 308 in the second position for a sufficient amount of time to extinguish cigar ash. The method may further comprise moving the blade 308 to a position where the through hole 312 is uncovered and collapsing the collapsible receptacle 316 to remove the cut cigar portion from the cigar cutter 300. Collapsing the collapsible receptacle simply requires applying force to the top of the collapsible receptacle in the direction of arrow 334 using a finger or the palm of the hand. In so doing, cut cigar material contained in the collapsible receptacle is discharged from the collapsible receptacle through the through hole 312.

The foregoing exemplary embodiments provide a cigar cutter including a receptacle for containing unburned cigar material, burning cigar material and/or ash that is cut from a cigar. According to each embodiment, the receptacle and cutter blade serve to enclose the cut cigar material whereby any burning cigar material may be quickly and safely extinguished within the receptacle. Once extinguished, the burnt cigar material and any unburned cigar material and ash may be conveniently stored in the receptacle until such time that the user gains access to a trash can or similar container within which to dump or otherwise discharge the cut cigar material from the receptacle for clean and safe disposal thereof. A further advantage of the cigar cutters according to the exemplary embodiments is that the palms of a user's hands are protected by the receptacle from hot ash and tobacco remnants that are cut from the cigar by the cutter blade. Moreover, cigar cutters according to the subject disclosure provide a freshly cut end to a cigar when a user is ready to relight the cigar. Additionally, a cigar cut by a cigar cutter according to the subject disclosure is easy to store because the smoky ash and burnt tobacco have been removed, whereby the cigar can be stored in a pocket, a bag, a humidor or virtually any container without fouling the container with residual cigar smoke odor.

It will be appreciated by those skilled in the art that changes could be made to the exemplary embodiments described above without departing from the broad inventive concept thereof. It is to be understood, therefore, that this disclosure is not limited to the particular embodiments disclosed, but it is intended to cover modifications within the spirit and scope of the subject disclosure as defined by the appended claims.

I claim:

1. A cigar cutter comprising:

a substantially planar housing body including a first surface and a second surface opposite the first surface;

a blade having a cutting edge, wherein the blade is movably mounted within the substantially planar housing body;

a through hole extending between the first and second surfaces, wherein the through hole includes a surface having a threaded fastener, and wherein the blade is moveable to pass the through hole substantially perpendicular to a central axis of the through hole; and a receptacle having an open end releasably engaging the threaded fastener.

2. The cigar cutter of claim 1, wherein the receptacle includes knurlings on an outer surface thereof.

3. The cigar cutter of claim 1, wherein the receptacle includes threads for engaging the threaded fastener.

4. The cigar cutter of claim 1, further comprising a first ring attached to the blade at an end thereof opposite the cutting edge, whereby movement of the first ring in a first direction moves the cutting edge to pass the through hole for allowing passage of a cigar through the through hole and into the receptacle, and movement of the first ring in a second direction moves the cutting edge pass the through hole for cutting the cigar inserted through the through hole and to seal the through hole, thereby enclosing ash or unburned cigar material in the receptacle.

5. The cigar cutter of claim 1, further comprising a seal hermetically sealing the receptacle when the blade covers the through hole.

6. A method for capturing and disposing of ash or unburned cigar material from a cigar comprising:

using the cigar cutter of claim 1, inserting a cigar within the through hole;

moving the blade to cover the through hole and cut the cigar; and holding the blade in the position covering the through hole for a sufficient amount of time to extinguish cigar ash within the receptacle.

7. A cigar cutter comprising:

a substantially planar housing body including a first surface and a second surface opposite the first surface;

a blade having a cutting edge, wherein the blade is movably mounted within the substantially planar housing body;

a through hole extending between the first and second surfaces, wherein the through hole includes a surface with a threaded fastener, and wherein the blade is moveable to pass the through hole substantially perpendicular to a central axis of the through hole;

a receptacle having an open end removably mounted to the second surface adjacent the through hole; and a seal adjacent the through hole.

8. The cigar cutter of claim 7, wherein the receptacle is a collapsible receptacle.

9. The cigar cutter of claim 8, wherein the collapsible receptacle includes a bellows side wall.

10. The cigar cutter of claim 8, wherein the collapsible receptacle comprises a metal.

11. The cigar cutter of claim 7, wherein the seal is an O-ring seal immediately adjacent the through hole.

12. A method for capturing and disposing of ash or unburned cigar material from a cigar comprising:

using the cigar cutter of claim 7, inserting a cigar within the through hole;

moving the blade to the second position; and holding the blade in the second position for a sufficient amount of time to extinguish the cigar ash.

13. The cigar cutter of claim 7, wherein the substantially planar housing further comprises male threads on the second surface circumscribing the through hole, and wherein the receptacle includes female threads for engaging the male threads.

14. The cigar cutter of claim 7, wherein the receptacle comprises:

an annular body, a gripping structure about an outer surface of the annular body, a closed end at one end of the annular body, an open end opposite the closed end, and threads adjacent the open end releasably engaging corresponding threads immediately adjacent the through hole and seal.

15. The cigar cutter of claim 7, wherein the cutting blade includes a substantially U-shaped cutting edge.

16. A cigar cutter comprising:

a substantially planar housing body including a first surface and a second surface opposite the first surface;

a blade having a cutting edge, wherein the blade is movably mounted within the substantially planar housing body;

a through hole extending between the first and second surfaces, wherein the through hole includes a surface having a threaded fastener, and wherein the blade is moveable to pass the through hole substantially perpendicular to a central axis of the through hole; and a receptacle having:

an annular body, a gripping structure about an outer surface of the annular body, a closed end at one end of the annular body, an open end opposite the closed end, and threads adjacent the open end for releasably engaging corresponding threads of the threaded fastener at the through hole.

* * * * *